US010161273B2

(12) United States Patent
Asahi et al.

(10) Patent No.: US 10,161,273 B2
(45) Date of Patent: Dec. 25, 2018

(54) VALVE OPENING AND CLOSING TIMING CONTROL APPARATUS

(71) Applicant: AISIN SEIKI KABUSHIKI KAISHA, Kariya-shi, Aichi (JP)

(72) Inventors: Takeo Asahi, Kariya (JP); Yuji Noguchi, Obu (JP); Toru Sakakibara, Anjo (JP); Masaki Kobayashi, Okazaki (JP); Yoshihiro Kawai, Obu (JP); Hiromitsu Shigyo, Toyota (JP); Hideyuki Suganuma, Anjo (JP)

(73) Assignee: AISIN SEIKI KABUSHIKI KAISHA, Kariya, Aichi (JP)

( * ) Notice: Subject to any disclaimer, the term of this patent is extended or adjusted under 35 U.S.C. 154(b) by 67 days.

(21) Appl. No.: 15/319,216

(22) PCT Filed: Oct. 20, 2015

(86) PCT No.: PCT/JP2015/079547
§ 371 (c)(1),
(2) Date: Dec. 15, 2016

(87) PCT Pub. No.: WO2016/063864
PCT Pub. Date: Apr. 28, 2016

(65) Prior Publication Data

US 2017/0268388 A1 Sep. 21, 2017

(30) Foreign Application Priority Data

Oct. 21, 2014 (JP) ..... 2014-214567

(51) Int. Cl.
*F01L 1/34* (2006.01)
*F01L 1/047* (2006.01)
*F01L 1/344* (2006.01)

(52) U.S. Cl.
CPC ..... *F01L 1/3442* (2013.01); *F01L 1/047* (2013.01); *F01L 2001/0476* (2013.01);
(Continued)

(58) Field of Classification Search
CPC ..... F01L 1/3442; F01L 2001/34426; F01L 2001/34433; F01L 1/047
See application file for complete search history.

(56) References Cited

U.S. PATENT DOCUMENTS 7,025,023 B2 4/2006 Lehmann et al.
2007/0095315 A1 5/2007 Hoppe et al.
(Continued)

FOREIGN PATENT DOCUMENTS

DE 10 2008 057 491 A 5/2010
JP 2009-515090 A 4/2009
(Continued)

OTHER PUBLICATIONS

International Preliminary Report on Patentability (Form PCT/IB/373) and a translation of the Written Opinion of the International Searching Authority (Form/PCT/IB237) dated Apr. 25, 2017 in corresponding International Application No. PCT/JP2015/079547 by the International Bureau. (8 Pgs).
(Continued)

*Primary Examiner* — Mark Laurenzi
*Assistant Examiner* — Wesley Harris
(74) *Attorney, Agent, or Firm* — Buchanan Ingersoll & Rooney PC

(57) ABSTRACT

A valve opening and closing timing control apparatus includes a driving-side rotational body, a driven-side rotational body, a cylindrical member provided at an inner portion of the driven-side rotational body, a bolt including a cylinder shaft portion, an advanced angle flow passage and a retarded angle flow passage, an introduction passage
(Continued)

bringing the working fluid supplied from an outside to flow, a first connection passage bringing the working fluid at the introduction passage to flow to an inner side of the cylinder shaft portion, a second communication passage and a third communication passage arranged at the cylinder shaft portion, and a control valve element provided at the inner side of the cylinder shaft portion, the second communication passage and the advanced angle flow passage being in communication with a void provided between the bolt head and the cylindrical member and between the cylinder shaft portion and the driven-side rotational body.

7 Claims, 7 Drawing Sheets

(52) U.S. Cl.
CPC ..... *F01L 2001/3443* (2013.01); *F01L 2001/34426* (2013.01); *F01L 2001/34433* (2013.01); *F01L 2001/34463* (2013.01); *F01L 2001/34469* (2013.01); *F01L 2001/34483* (2013.01); *F01L 2101/00* (2013.01); *F01L 2250/02* (2013.01)

(56) References Cited

U.S. PATENT DOCUMENTS

| | | | | |
|---|---|---|---|---|
| 2008/0149056 | A1* | 6/2008 | Grunow | F01L 1/34 123/90.17 |
| 2012/0097122 | A1* | 4/2012 | Lichti | F01L 1/3442 123/90.15 |
| 2012/0255509 | A1 | 10/2012 | Lichti et al. | |
| 2015/0059669 | A1* | 3/2015 | Yamakawa | F01L 1/3442 123/90.15 |

FOREIGN PATENT DOCUMENTS

| | | | |
|---|---|---|---|
| JP | 2012-036768 | A | 2/2012 |
| JP | 2012-219815 | A | 11/2012 |

OTHER PUBLICATIONS

U.S. Appl. No. 15/318,943, filed Dec. 14, 2016, Noguchi et al.
International Search Report (PCT/ISA/210) dated Jan. 26, 2016, by the Japan Patent Office as the International Searching Authority for International Application No. PCT/JP2015/079547.
Written Opinion (PCT/ISA/237) dated Jan. 26, 2016, by the Japan Patent Office as the International Searching Authority for International Application No. PCT/JP2015/079547.

* cited by examiner

VALVE OPENING AND CLOSING TIMING CONTROL APPARATUS

TECHNICAL FIELD

This invention relates to a valve opening and closing timing control apparatus changing a relative rotational phase between a driving-side rotational body which synchronously rotates with a drive shaft of an internal combustion engine and a driven-side rotational body which integrally rotates with a camshaft for opening and closing a valve of the internal combustion engine.

BACKGROUND ART

Each of Patent documents 1 to 3 discloses a valve opening and closing timing control apparatus including a cylindrical member provided at an inner portion of a driven-side rotational body and a bolt connecting the driven-side rotational body and a camshaft. In addition, an introduction passage which brings a working fluid supplied from an outside to flow in a direction of a rotation axis is provided so as to supply the working fluid to an advanced angle chamber and a retarded angle chamber.

The bolt includes a cylinder shaft portion between a bolt head and an externally threaded portion. A second communication passage and a third communication passage are provided at the cylinder shaft portion by penetrating therethrough in a direction orthogonal to the rotation axis so that the working fluid is configured to separately flow to an advanced angle flow passage and a retarded angle flow passage. The second communication passage and the third communication passage are provided at different positions in a circumferential direction of the rotation axis relative to the introduction passage and at different positions along a longitudinal direction of the rotation axis. A control valve element which moves in a reciprocating manner along the rotation axis is provided at an inner portion of the cylinder shaft portion. The working fluid from the introduction passage is supplied switchably to the second communication passage and the third communication passage depending on a position of the control valve element.

DOCUMENT OF PRIOR ART

Patent Document

Patent document 1: Japanese Patent Application Publication 2009-515090

Patent document 2: U.S. Patent Application Publication 2012/0097122

Patent document 3: German Patent Application Publication 102008057491

OVERVIEW OF INVENTION

Problem to be Solved by Invention

According to the valve opening and closing timing control apparatus disclosed in Patent document 1, the cylindrical member (sleeve) which forms the introduction passage (pressure passage) with the cylinder shaft portion (valve housing) is provided at an inner side of the cylinder shaft portion between the cylinder shaft portion and the control valve element (control piston). Therefore, the cylindrical member may easily wear away with a reciprocation movement of the control valve element. A sealing ability of a boundary face between the control valve element and the cylindrical member may decrease, which may lead to a leakage of the working fluid. In a case where the working fluid leaks from the boundary face between the control valve element and the cylindrical member, a supply speed of the working fluid to the advanced angle chamber or the retarded angle chamber decreases, which deteriorates a control responsiveness of the relative rotational phase.

According to the valve opening and closing timing control apparatus disclosed in Patent document 2, the cylindrical member that forms the introduction passage with the camshaft and the driven-side rotation body is provided at an outer side of the cylinder shaft portion between the cylinder shaft portion and the driven-side rotation body. In such constriction, the cylindrical member is inhibited from wearing away by the reciprocation movement of the control valve element. The working fluid is unlikely to leak by a decrease of the sealing ability. Nevertheless, because an annular groove, a supply passage of a penetration bore in communication with the annular groove, and an advanced angle passage or a retarded angle passage in communication with the annular grove are provided at a cylinder wall portion of the cylindrical member, a manufacture of the cylindrical member is complicated.

According to the valve opening and closing timing control apparatus disclosed in Patent document 3, the cylindrical member where the introduction passage is provided at an inner portion is provided at an outer side of the cylinder shaft portion between the cylinder shaft portion and the driven-side rotation body. In such construction, the cylindrical member is inhibited from wearing away by the reciprocation movement of the control valve element. The working fluid is unlikely to leak by the decrease of the sealing ability. Nevertheless, because a force for tightening the driven-side rotational body to the camshaft is configured to be applied to the cylindrical member, the cylindrical member may be easily deformed. In a case where the cylindrical member is deformed, the working fluid leaks from a boundary face between the cylindrical member and the cylinder shaft portion or the driven-side rotational body. The supply speed of the working fluid to the advanced angle chamber or the retarded angle chamber decreases, which deteriorates the control responsiveness of the relative rotational phase.

The present invention is made in view of the drawback mentioned above and an object of the invention is to provide a valve opening and closing timing control apparatus where a flow passage of a working fluid is easily provided and a control responsiveness of a relative rotational phase improves.

Means for Solving Problem

A characteristic construction of a valve opening and closing timing control apparatus according to the present invention includes a driving-side rotational body synchronously rotating with a drive shaft of an internal combustion engine, a driven-side rotational body supported at an inner side of the driving-side rotational body to be rotatable at a rotation axis serving as a common rotation axis between the driven-side rotational body and the driving-side rotational body, the driven-side rotational body integrally rotating with a camshaft for opening and closing a valve of the internal combustion engine, a cylindrical member provided at an inner portion of the driven-side rotational body, a bolt including a cylinder shaft portion inserted to be positioned at an inner side of the cylindrical member, a bolt head continuously provided to the cylinder shaft portion and an externally threaded portion being different from the bolt head and continuously provided to the cylinder shaft portion, the bolt connecting the driven-side rotational body and the camshaft, an advanced angle chamber and a retarded angle chamber defined and provided between the driving-side rotational body and the driven-side rotational body, an advanced angle flow passage and a retarded angle flow passage provided at the driven-side rotational body, the advanced angle flow passage being in communication with the advanced angle chamber, the retarded angle flow passage being in communication with the retarded angle chamber, an introduction passage provided at least at one of the cylinder shaft portion and the cylindrical member between the cylinder shaft portion and the cylindrical member, the introduction passage bringing a working fluid supplied from an outside to flow along a direction of the rotation axis, a first connection passage provided at the cylinder shaft portion to bring the working fluid at the introduction passage to flow to an inner side of the cylinder shaft portion, a second communication passage and a third communication passage arranged at different positions from each other at the cylinder shaft portion along the direction of the rotation axis, and a control valve element provided at the inner side of the cylinder shaft portion to move in a reciprocating manner along the rotation axis, the control valve element supplying the working fluid from the first communication passage to the second communication passage or the third communication passage, either a combination of the second communication passage and the advanced angle flow passage or a combination of the third communication passage and the retarded angle flow passage being in communication with a void provided between the bolt head and the cylindrical member and between the cylinder shaft portion and the driven-side rotational body.

The valve opening and closing timing control apparatus with the above construction includes the bolt including the cylinder shaft portion inserted to be positioned at the inner side of the cylindrical member, the bolt head continuously provided to the cylinder shaft portion and the externally threaded portion being different from the bolt head and continuously provided to the cylinder shaft portion, the bolt connecting the driven-side rotational body and the camshaft, and the control valve element provided at the inner side of the cylinder shaft portion to move in a reciprocating manner along the rotation axis. Thus, the cylindrical member is inhibited from wearing away by a reciprocation movement of the control valve element. The working fluid is unlikely to leak by a decrease of a sealing ability at a boundary face between the control valve element and the cylindrical member.

In addition, the valve opening and closing timing control apparatus with the above construction includes the cylinder shaft portion inserted to be positioned at the inner side of the cylindrical member, and the introduction passage provided at least at one of the cylinder shaft portion and the cylindrical member between the cylinder shaft portion and the cylindrical member. Thus, the introduction passage is arranged at a different phase in a circumferential direction relative to the advanced angle flow passage and the retarded angle passage. As compared to a case where the introduction passage is arranged along an axial direction relative to the advanced angle flow passage and the retarded angle passage, the sealing ability improves.

Further, either the combination of the second communication passage and the advanced angle flow passage or the combination of the third communication passage and the retarded angle flow passage is in communication with the void provided between the bolt head and the cylindrical member and between the cylinder shaft portion and the driven-side rotational body.

That is, as illustrated in a left-side portion of FIG. 14, a void 6*a* with a depth corresponding to a thickness of a cylindrical member 4 is provided between a bolt head 5*b* and the cylindrical member 4 and between a cylinder shaft portion 5*c* and a driven-side rotational body 3. Thus, in a case where an annular flow passage 9*a* with a predetermined depth H for a communication between the second communication passage and the advanced angle flow passage or between the third communication passage and the retarded angle flow passage is provided between the cylinder shaft portion 5*c* and the driven-side rotational body 3, the void 6*a* may be partially or fully utilized as the annular flow passage 9*a*.

On the other hand, as illustrated in a right-side portion of FIG. 14, if the cylinder shaft portion 5*c* is inserted to be positioned within the cylindrical member 4 so that the void 6*a* is inhibited from being provided, a cutting work corresponding to an amount of the predetermined depth H is necessarily conducted on the driven-side rotational body 3 for providing the annular flow passage 9*a* with the predetermined depth H. As compared to an embodiment in the left-side portion of FIG. 14, time and effort is required for processing.

In addition, the cylindrical member is inhibited from making contact with the bolt head. Accordingly, a deformation of the bolt head caused by the contact with the cylindrical member is restrained, which may inhibit a decrease of a bolt axial force caused by the deformation of the cylindrical member. A reduced length of the cylindrical member may achieve a weight saving and a cost reduction.

Thus, according to the present construction, in order to provide the annular flow passage with the predetermined depth between the cylinder shaft portion and the driven-side rotational body, time and effort for the cutting work on an outer peripheral side of the cylinder shaft portion or on an inner peripheral side of the driven-side rotational body may be lightened or reduced.

As a result, according to the valve opening and closing timing control apparatus including the present construction, a leakage of the working fluid caused by the decrease of the sealing ability is unlikely to occur. A control responsiveness of a relative rotational phase may improve. In addition, a manufacture of the cylindrical member that forms the introduction passage with the cylinder shaft portion and a manufacture of the cylinder shaft portion or the driven-side rotational body may be easily performed.

Another characteristic construction of the present invention is that an outer peripheral surface of the cylinder shaft portion is press-fitted to an inner peripheral surface of the cylindrical member.

According to the above construction, the communication of the first communication passage, the second communication passage and the third communication passage one another via a boundary face between the cylinder shaft portion and the cylindrical member or the leakage of fluid from those communication passages is inhibited, which may further improve the control responsiveness of the relative rotational phase.

Still another characteristic construction of the present invention is that the cylinder shaft portion includes an outer diameter greater than an outer diameter of the externally threaded portion, that the bolt includes a first contact surface provided at a stepped portion which is provided between the cylinder shaft portion and the externally threaded portion, and that the cylindrical member includes a second contact surface which makes contact with the first contact surface at a time of an insertion of the cylinder shaft portion to the cylindrical member.

According to the above construction, an insertion depth of the cylinder shaft portion relative to the cylindrical member may be restricted by the contact between the first contact surface and the second contact surface at the time of the insertion of the cylinder shaft portion to the cylindrical member so that the cylindrical member is inhibited from being compressed or deformed in an insertion direction by an insertion pressure of the cylinder shaft portion.

Accordingly, a concern of buckling of the cylindrical member at the time of the insertion of the cylinder shaft portion to the cylindrical member is eliminated so that an insertion performance and a press-fitting performance of the cylinder shaft portion to the cylindrical member are both obtained to thereby improve productivity. Further, in a case where the cylindrical member is formed by plastic forming such as drawing, for example, an inner side of a bending portion which is work-hardened remains as the second contact surface so that the portion which is work-hardened is not required to be removed. The productivity of the cylindrical member therefore improves.

Still another characteristic construction of the present invention is that the cylinder shaft portion includes a large diameter portion continuously provided to the bolt head and a small diameter portion including a smaller diameter than the large diameter portion and inserted to be positioned within the cylindrical member, and that the cylindrical member includes a greater outer diameter than the large diameter portion.

According to the above construction, the insertion depth of the cylinder shaft portion relative to the cylindrical member may be restricted by the contact of the cylindrical member relative to a stepped portion between the large diameter portion and the small diameter portion in the direction of the rotation axis. In addition, a void with a depth corresponding to a difference in level between the large diameter portion and the cylindrical member may be provided between the driven-side rotational body at a side connected to the bolt head and the cylinder shaft portion.

Accordingly, at the side where the driven-side rotational body is in contact with the bolt head, an inner diameter of the driven-side rotational body necessary for providing the annular flow passage with the predetermined depth between the cylinder shaft portion and the driven-side rotational body may be reduced by the depth of the void. Thus, even in a case where an outer diameter of the bolt head is specified to be small, a contact area with the driven-side rotational body may be easily largely secured. A downsizing of the apparatus caused by a reduced diameter of the bolt head and improvement of the sealing ability of a boundary face between the bolt head and the driven-side rotational body may be obtained.

Still another characteristic construction of the present invention is that at least one of a contact surface of the cylindrical member and a contact surface of the larger diameter portion, the contact surfaces at which the cylindrical member and the larger diameter portion face each other in the direction of the rotation axis, is separating from the rotation axis while approaching the bolt head.

According to the above construction, the contact surfaces between the cylindrical member and the large diameter portion may be largely secured to improve the sealing ability at the boundary face between the cylindrical member and the cylinder shaft portion. In addition, at least one of the contact surfaces of the cylindrical member and the large diameter portion may function as a guide surface upon press-fitting of the bolt to the inner side of the cylindrical member. Thus, an insertion resistance of the bolt to the cylindrical member may be reduced to improve an assembly workability of the bolt.

Still another characteristic construction of the present invention is that a cutting is provided at an end portion of the cylindrical member facing the bolt head, the cutting conforming to an opening configuration of the second communication passage or the third communication passage.

According to the above construction, while the communication between the second communication passage or the third communication passage and the void is secured, an overlapping range between the cylindrical member and the cylinder shaft portion is largely secured, which may improve the sealing ability at the boundary face between the cylindrical member and the cylinder shaft portion.

Still another characteristic construction of the present invention is that a distance from the rotation axis to an end portion of the cylindrical member decreases towards the externally threaded portion.

According to the above construction, in a case where the bolt is assembled on the inner portion of the driven-side rotational body together with the cylindrical member, the bolt may be easily assembled so as not to interfere with the driven-side rotational body, which may improve the assembly workability of the bolt.

MODE FOR CARRYING OUT THE INVENTION

Embodiments of the present invention are explained as blow with reference to drawings.

First Embodiment

Figure 1:
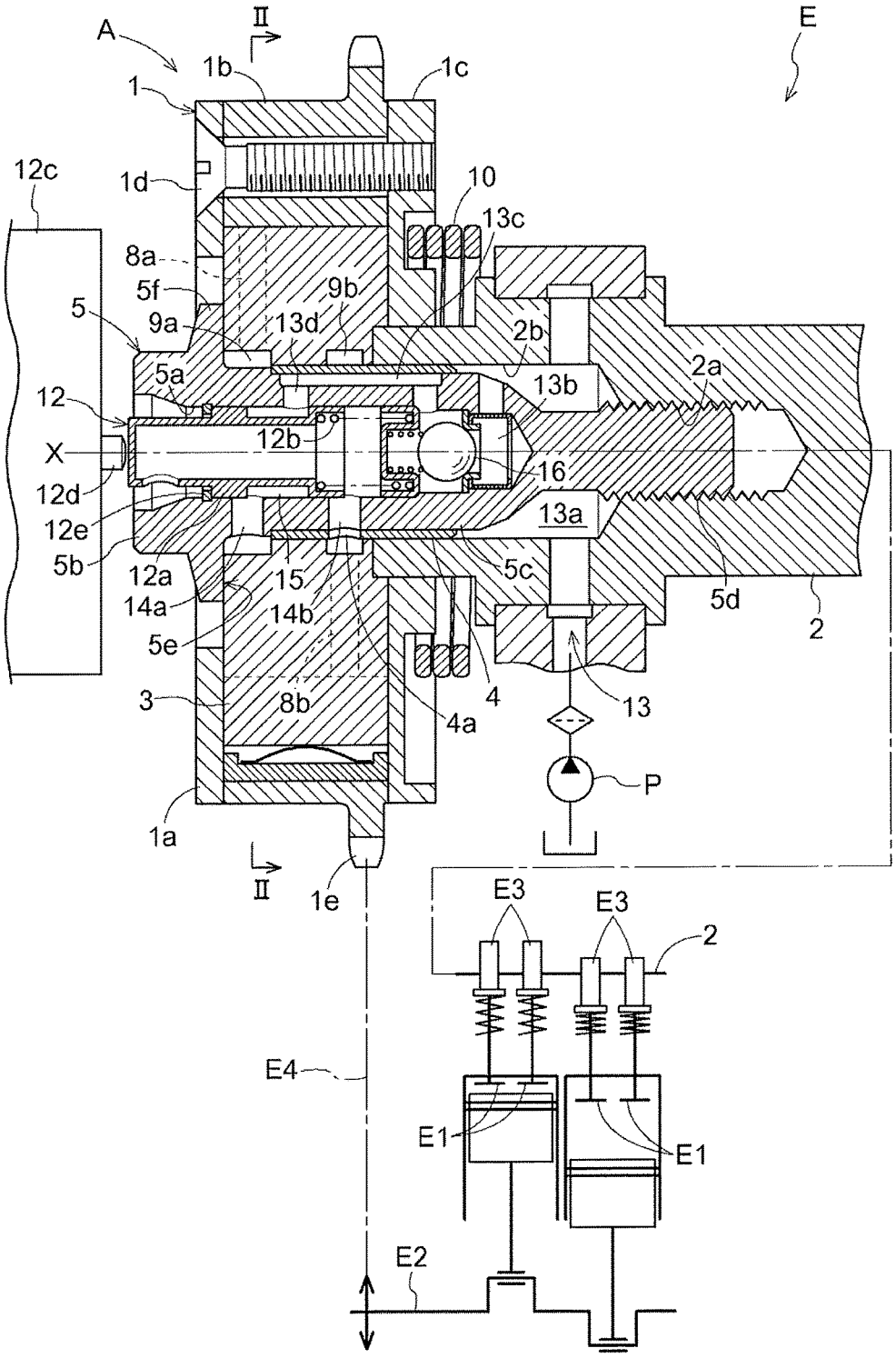
FIG. 1 is a cross-sectional view illustrating an entire construction of a valve opening and closing timing control apparatus.
Figure 2:
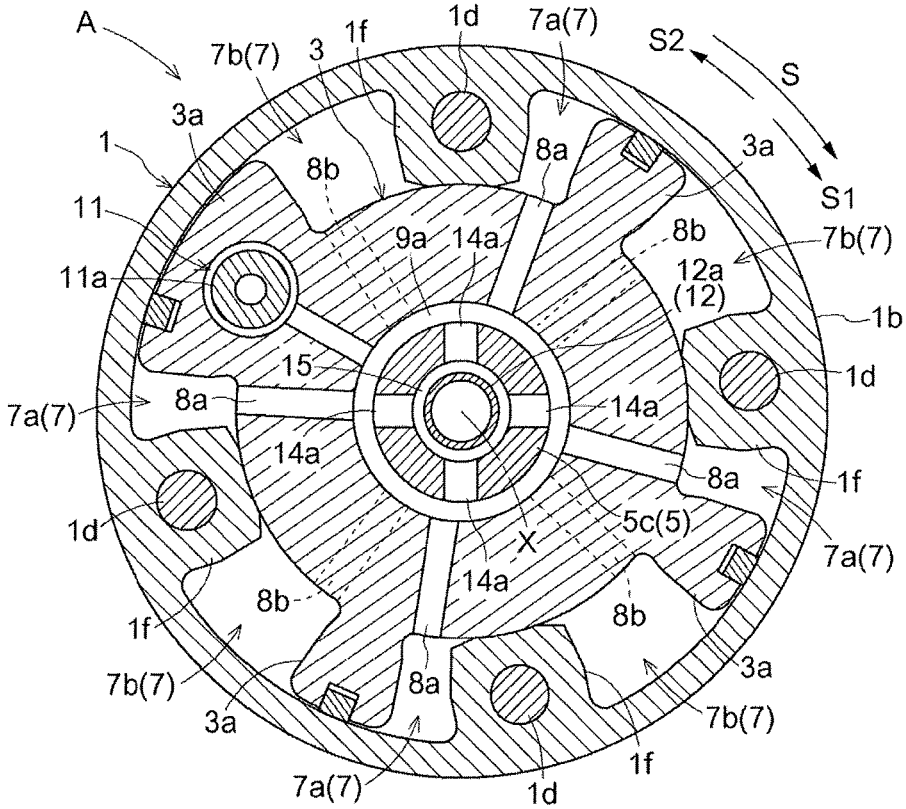
FIG. 2 is a cross-sectional view taken along line II-II and viewed in an arrow direction in FIG. 1.

FIGS. 1 to 9 each illustrate a valve opening and closing timing control apparatus A according to the present embodiment. The valve opening and closing timing control apparatus A controls an opening and closing timing of each intake valve E1 of an engine E for an automobile. As illustrated in FIGS. 1 and 2, the valve opening and closing timing control apparatus A includes a housing 1 made of aluminum alloy and rotating in synchronization with a crankshaft E2 of the engine E. The valve opening and closing timing control apparatus A also includes an inner rotor 3 made of aluminum alloy and rotating integrally with a camshaft 2 for opening and closing the intake valves in a state where the inner rotor 3 is supported at an inner side of the housing 1 to be rotatable around a rotation axis X serving as a common rotation axis between the inner rotor 3 and the housing 1.

A sleeve 4 made of resin or aluminum alloy and an OCV bolt 5 made of steel and connecting the inner rotor 3 and the camshaft 2 are provided at an inner portion of the inner rotor 3. The OCV bolt 5 is formed in a cylindrical configuration including a cylinder shaft portion 5*c* inserted to be positioned at an inner side of the sleeve 4, a bolt head 5*b* continuously provided to the cylinder shaft portion 5*c* and an externally threaded portion 5*d* being different from the bolt head 5*b* and continuously provided to the cylinder shaft portion 5*c*. An inner void 5*a* of the cylinder shaft portion 5*c* opens to the bolt head 5*b*.

The bolt head 5*b* includes a flange 5*f* which includes a press-contact surface 5*e* relative to the inner rotor 3. The cylinder shaft portion 5*c* includes an outer diameter greater than an outer diameter of the externally threaded portion 5*d*. The OCV bolt 5 is inserted to be positioned within the inner rotor 3 in a state where an outer peripheral surface of the cylinder shaft portion 5*c* is press-fitted to an inner peripheral surface of the sleeve 4 beforehand.

The camshaft 2 serves as a rotation shaft of cams E3 which control opening and closing of the intake valves E1 of the engine E. The camshaft 2 synchronously rotates with the inner rotor 3 and the OCV bolt 5 in a state being rotatably supported at a cylinder head of the engine E. A screw bore 2*b* is coaxially provided at the camshaft 2 at a side connected to the inner rotor 3. The screw bore 2*b* includes an internally threaded portion 2*a* at a back side. The OCV bolt 5 tightens and fixes the inner rotor 3 in a coaxial manner relative to the camshaft 2 by a meshing of the externally threaded portion 5*d* with the internally threaded portion 2*a* provided at the camshaft 2.

In the present embodiment, the engine E for the automobile corresponds to an "internal combustion engine". The crankshaft E2 corresponds to a "drive shaft of the internal combustion engine". The housing 1 corresponds to a "driving-side rotational body". The inner rotor 3 corresponds to a "driven-side rotational body". The sleeve 4 corresponds to a "cylindrical member".

The housing 1 is configured by integrally connecting a front plate 1*a* provided at a side opposite from a side where the camshaft 2 exists, an outer rotor 1*b* mounted externally to the inner rotor 3 and a rear plate 1*c* provided at the side where the camshaft 2 exists by a connection bolt 1*d*. The outer rotor 1*b* integrally includes a timing sprocket 1*e*. An endless rotary body E4 such as a metal chain, for example, interlocking with the rotation of the crankshaft E2 is wound at the timing sprocket 1*e*.

In a case where the crankshaft E2 is driven to rotate, a rotary power is transmitted to the outer rotor 1*b* by the endless rotary body E4. The housing 1 is driven to rotate in a rotation direction S in FIG. 2. With the rotation and driving of the housing 1, the inner rotor 3 is driven to rotate in the rotation direction S so that the camshaft 2 rotates. The cams E3 press down the intake valves E1 of the engine E to open the intake valves E1.

As illustrated in FIG. 2, the inner rotor 3 is housed in the housing 1. Fluid chambers 7 are defined and provided between the housing 1 and the inner rotor 3. The fluid chambers 7 are defined by plural projecting portions if provided at the outer rotor 1*b* at intervals in the rotation direction S in a state where the projecting portions if protrude to a radially inner side. Each of the fluid chambers 7 is defined into an advanced angle chamber 7*a* and a retarded angle chamber 7*b* in the rotation direction S by a projecting portion 3*a* provided at the inner rotor 3 to protrude radially outward.

An advanced angle flow passage 8*a* in communication with the advanced angle chamber 7*a* and a retarded angle flow passage 8*b* in communication with the retarded angle chamber 7*b* are provided at the inner rotor 3 to penetrate therethrough along a radial direction of the inner rotor 3 in a state where a position of the advanced angle flow passage 8*a* and a position of the retarded angle flow passage 8*b* are different from each other in a direction of the rotation axis X. The advanced angle flow passage 8*a* is in communication with an advanced angle annular flow passage 9*a* which is provided between the cylinder shaft portion 5*c* and the inner rotor 3 while facing the press-contact surface 5*e* of the bolt head 5*b* relative to the inner rotor 3. The retarded angle flow passage 8*b* is in communication with a retarded angle annular flow passage 9*b* which is obtained by an annular peripheral groove provided at an inner peripheral surface of the inner rotor 3.

Figure 8:
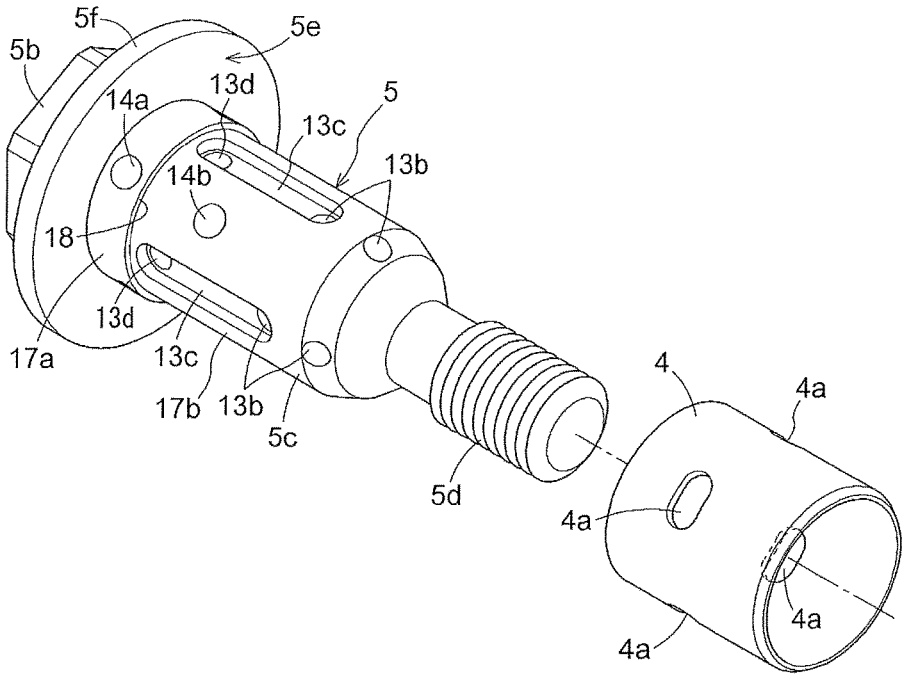
FIG. 8 is an exploded perspective view illustrating the bolt and the cylindrical member (sleeve)

As also illustrated in FIG. 8, the cylinder shaft portion 5*c* includes a large diameter portion 17*a* continuously provided to the bolt head 5*b* and a small diameter portion 17*b* provided at a side where the externally threaded portion 5*d* is disposed. The small diameter portion 17*b*, which includes an outer diameter smaller than an outer diameter of the large diameter portion 17*a*, is press-fitted to the sleeve 4. The sleeve 4 includes an outer diameter greater than the outer diameter of the large diameter portion 17*a*.

Figure 6:
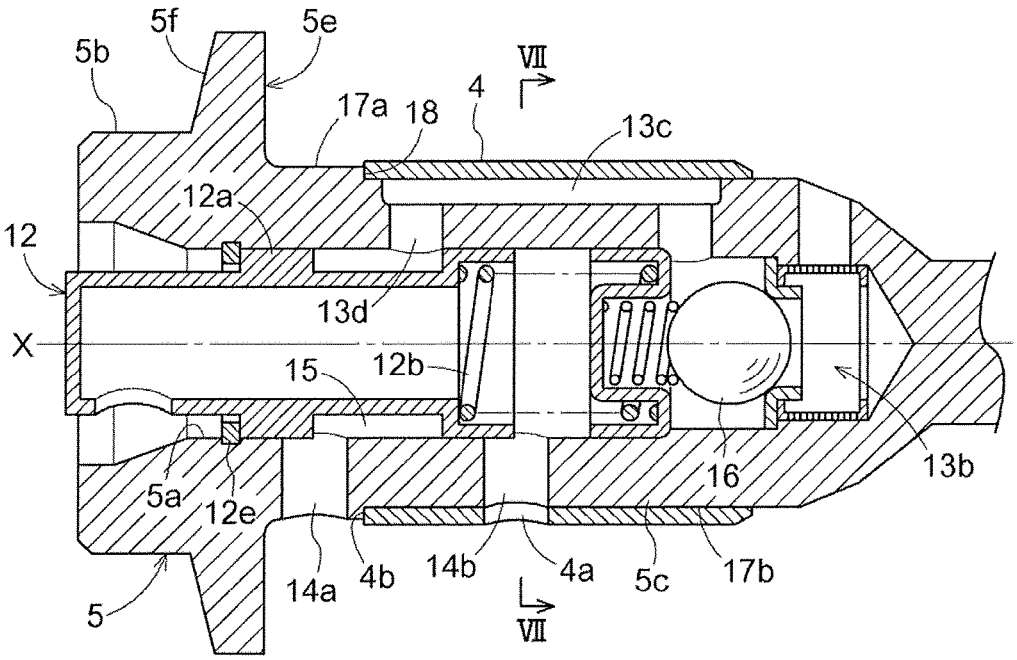
FIG. 6 is a cross-sectional view illustrating a bolt where a cylinder shaft portion is press-fitted to a cylindrical member (sleeve)
Figure 7:
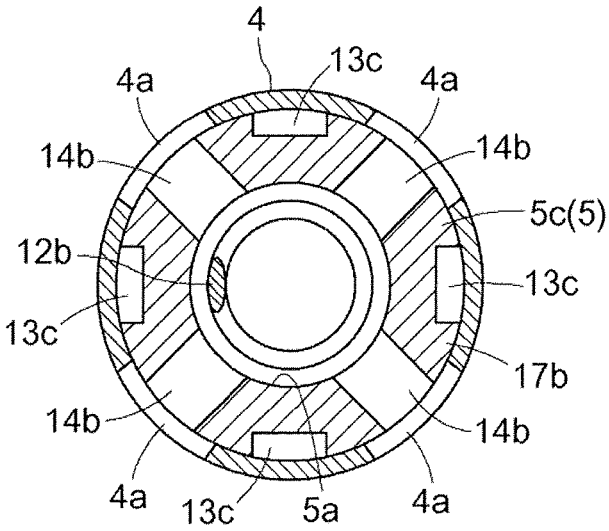
FIG. 7 is a cross-sectional view taken along line VII-VII and viewed in an arrow direction in FIG. 6.

A stepped portion 18 between the large diameter portion 17*a* and the small diameter portion 17*b* is obtained by an annular flat face along a direction orthogonal to the rotation axis X (refer to FIGS. 6 and 8). In the present embodiment, a bolt head-side end surface 4*b* of the sleeve 4 is in contact with the stepped portion (flat face) 18. Alternatively, the bolt head-side end surface 4*b* may be away from the stepped portion 18.

Figure 9:
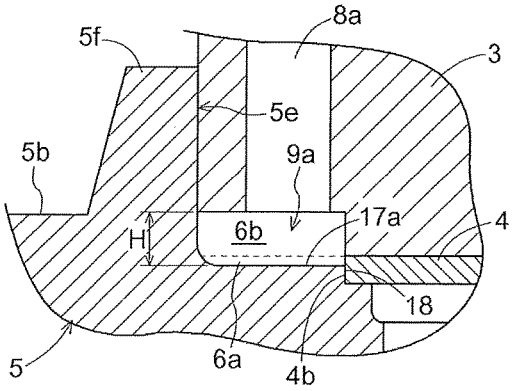
FIG. 9 is a cross-sectional view illustrating an advanced angle annular flow passage.

As also illustrated in FIG. 9, a first annular void 6*a* is provided between the bolt head 5*b* and the sleeve 4 and between an outer peripheral surface of the large diameter portion 17*a* and the inner rotor 3. In addition, a second annular void 6*b* is provided between the bolt head 5*b* and the inner rotor 3 in a state where a cutting including an L-shaped cross section is formed in a continuous annular form at a corner portion of an inner peripheral portion of the inner rotor 3 at a side where the bolt head 5*b* is provided. Accordingly, the advanced angle annular flow passage 9*a* is formed with a predetermined depth H by the first annular void 6*a* and the second annular void 6*b*.

Supply, discharge or interruption of supply and discharge of oil (working fluid) relative to the advanced angle chambers 7*a* and the retarded angle chambers 7*b* through the advanced angle flow passages 8*a* and the retarded angle flow passages 8*b* causes an oil pressure to be applied to the projecting portions 3*a* so that the relative rotational phase is changed to an advanced angle direction or to a retarded angle direction, or is held at an arbitral phase. A spring 10 engages between the camshaft 2 and the rear plate 1*c* so as to bias the inner rotor 3 in the advanced direction relative to the housing 1.

The advanced angle direction corresponds to a direction in which a volume of the advanced angle chambers 7*a* increases as indicated by an arrow S1 in FIG. 2. The retarded angle direction corresponds to a direction in which a volume of the retarded angle chambers 7*b* increases as indicated by an arrow S2 in FIG. 2. The relative rotational phase obtained in a case where the volume of the advanced angle chambers 7*a* becomes maximum is a most advanced angle phase. The relative rotational phase obtained in a case where the volume of the retarded angle chambers 7*b* becomes maximum is a most retarded angle phase.

A lock mechanism 11 is provided so that the relative rotational phase of the inner rotor 3 relative to the housing 1 may be locked at a lock phase between the most advanced angle phase and the most retarded angle phase by locking a relative rotational movement of the inner rotor 3 relative to the housing 1 (refer to FIG. 2). The lock mechanism 11 includes a lock member 11*a* which extends and retracts in the direction of the rotation axis X by a hydraulic operation. The lock member 11*a* engages with the front plate 1*a* or the rear plate 1*c* so that the relative rotational phase is locked at the lock phase. The lock mechanism 11 may be configured to lock the relative rotational phase at either the most advanced angle phase or the most retarded angle phase.

In the present embodiment, an OCV (oil control valve) 12 corresponds to a control valve. The OCV 12 is arranged coaxially with the camshaft 2. The OCV 12 switches the supply and discharge of the oil relative to the advanced angle chambers 7*a* and the retarded angle chambers 7*b* through the advanced angle flow passages 8*a* and the retarded angle flow passages 8*b* so that the relative rotational phase between the housing 1 and the inner rotor 3 is changed between the most advanced angle phase and the most retarded angle phase.

The OCV 12 includes a spool 12*a* in a cylindrical form, a spring 12*b* biasing the spool 12*a* in a direction where the spool 12*a* protrudes outward from the cylinder shaft portion 5*c* and an electromagnetic solenoid 12*c* driving and moving the spool 12*a* against a biasing force of the spring 12*b*.

The spool 12*a* is housed at an inner side of the OCV bolt 5, i.e., is housed at the inner void 5*a* of the cylinder shaft portion 5*c* to slidably move in a reciprocating manner along the direction of the rotation axis X. The spool 12*a* is constantly biased by the spring 12*b* in a direction to protrude outward from the inner void 5*a*. A stopper piece 12*e* is provided at the inner side of the OCV bolt 5 so as to inhibit disengagement of the spool 12*a*. The spool 12*a* corresponds to a "control valve element".

The spool 12*a* is inhibited from disengaging from the OCV bolt 5 by the stopper piece 12*e*. In a case where an electric power is supplied to the electromagnetic solenoid 12*c*, a push pin 12*d* presses the spool 12*a* so that the spool 12*a* moves in a sliding manner towards the camshaft 2 against the biasing force of the spring 12*b*. The OCV 12 may adjust a position of the spool 12*a* by adjusting a duty ratio of the electric power supplied to the electromagnetic solenoid 12*c*. A power supply volume to the electromagnetic solenoid 12*c* is controlled by an ECU (electronic control unit) not illustrated.

A supply flow passage 13 is provided to supply the oil which is supplied from an oil pump P from an outside such as an oil pan, for example, selectively to the advanced angle flow passages 8*a* and to the retarded angle flow passages 8*b* via the OCV 12. The supply flow passage 13 includes a bolt outer peripheral flow passage 13*a*, a bolt inner flow passage 13*b*, an introduction passage 13*c*, a first communication passage 13*d*, a second communication passage 14*a* and a third communication passage 14*b*.

The bolt outer peripheral flow passage 13*a* is provided at the screw bore 2*b* of the camshaft 2 so as to surround an outer peripheral side of the OCV bolt 5. The bolt inner flow passage 13*b* is provided at an inner portion of the OCV bolt 5. The introduction passage 13*c* is obtained by an elongated groove provided at the outer peripheral surface of the cylinder shaft portion 5*c* between the OCV bolt 5 and the sleeve 4. The introduction passage 13*c* brings the oil from the bolt inner flow passage 13*b* to flow along a longitudinal direction of the rotation axis X. The first communication passage 13*d* is provided penetrating through a cylinder wall of the cylinder shaft portion 5*c*. The first communication passage 13*d* brings the oil introduced to the introduction passage 13*c* to flow to the inner side of the cylinder shaft portion 5*c*. The second communication passage 14*a* penetrates through the large diameter portion 17*a* of the cylinder shaft portion 5*c* in a cylinder diameter direction orthogonal to the rotation axis X. The third communication passage 14*b* penetrates through the small diameter portion 17*b* of the cylinder shaft portion 5*c* and the sleeve 4 in the cylinder diameter direction orthogonal to the rotation axis X. In the present embodiment, a combination of the second communication passage 14*a* and the advanced angle flow passage 8*a* is in communication with the first annular void 6*a*.

The second communication passage 14*a* and the third communication passage 14*b* are provided at different positions along a circumferential direction of the rotation axis X relative to the introduction passage 13*c* and at different positions along the longitudinal direction of the rotation axis X so that the oil at the inner side of the OCV bolt 5 separately flows to the advanced angle flow passage 8*a* and the retarded angle flow passage 8*b*.

Because the sleeve 4 is press-fitted to the small diameter portion 17*b*, a sealing ability between the sleeve 4 and the cylinder shaft portion 5*c* may improve to reduce an oil leakage. A bolt head-side end of the sleeve 4 is disposed between the second communication passage 14*a* and the third communication passage 14*b*.

The sleeve 4 is inhibited from being press-fitted to the large diameter portion 17*a* and thus the sleeve 4 is not in contact with the flange 5*f*. Thus, a highly accurate processing range at the OCV bolt 5 may be reduced, which may decrease a processing cost of the OCV bolt 5.

The sleeve 4 includes a sleeve-side communication passage 4*a* for connecting the retarded angle annular flow passage 9*b* and the third communication passage 14*b*. The sleeve-side communication passage 4*a* is obtained by an elongated bore elongated around the rotation axis X. Accordingly, an assembly tolerance of the sleeve 4 relative to the cylinder shaft portion 5*c* and the inner rotor 3 around the rotation axis X may be specified to be large. An easy assembly is achievable so that the retarded angle annular flow passage 9*b* and the third communication passage 14*b* are in communication with each other, which may improve an assembly workability.

The spool 12*a* includes a valve element peripheral groove 15 in an annular form at an outer peripheral surface so as to switch between a neutral state (FIG. 3) in which the introduction passage 13*c* is inhibited from being in communication with the second communication passage 14*a* or the third communication passage 14*b*, an advanced angle control state (FIG. 4) in which the introduction passage 13*c* is only in communication with the second communication passage 14*a* and a retarded angle control state (FIG. 5) in which the introduction passage 13*c* is only in communication with the third communication passage 14*b*. The power supply to the electromagnetic solenoid 12*c* is stopped so that the spool 12*a* is switched to the advanced angle control state. The power supply volume to the electromagnetic solenoid 12*c* is controlled so that the spool 12*a* is switched to either the neutral state or the retarded angle control state.

A ball-type check valve 16 is provided at an inner portion of the cylinder shaft portion 5*c* to be disposed at a portion of the bolt inner flow passage 13*b*. The ball-type check valve 16 interrupts a flow of the oil to the introduction passage 13*c* and blocks a reflux of the oil from the introduction passage 13*c* in a state where a supply pressure of the oil is equal to or smaller than a set pressure, and permits the flow of the oil to the introduction passage 13*c* in a case where the supply pressure of the oil exceeds the set pressure.

Figure 3:
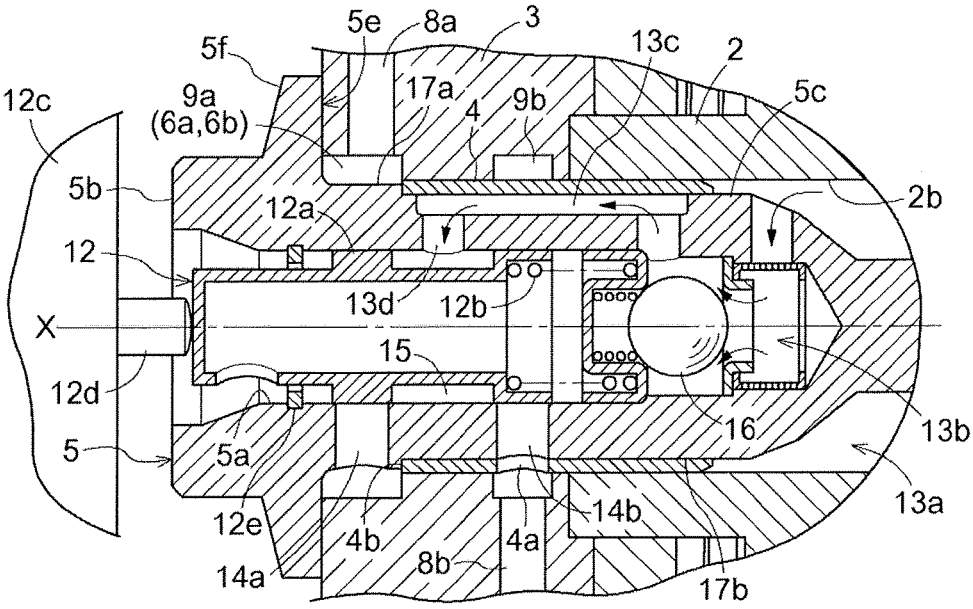
FIG. 3 is a cross-sectional view illustrating a position of a control valve element in a neutral state.

In the neutral state as illustrated in FIG. 3, the spool 12*a* moves to a position at which the first communication passage 13*d* is only in communication with the valve element peripheral groove 15 and either the second communication passage 14*a* or the third communication passage 14*b* is inhibited from being in communication with the valve element peripheral groove 15. In the neutral state, the supply and discharge of the oil to the advanced angle chamber 7*a* and the retarded angle chamber 7*b* are stopped, so that the relative rotational phase does not change.

Figure 4:
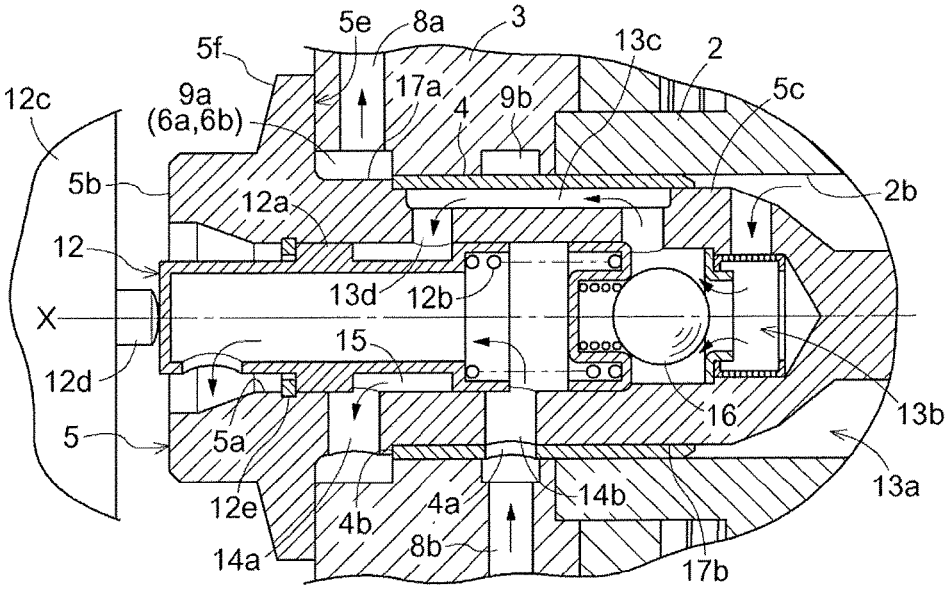
FIG. 4 is a cross-sectional view illustrating a position of the control valve element in an advanced angle control state.

In the advanced angle control state as illustrated in FIG. 4, the spool 12*a* moves to a position at which the first communication passage 13*d* and the second communication passage 14*a* are in communication with each other via the valve element peripheral groove 15 and the third communication passage 14*b* is in communication with the inner void 5*a*. In the advanced angle control state, the oil is supplied to the advanced angle chamber 7*a* via the advanced angle flow passage 8*a* and the oil in the retarded angle chamber 7*b* is discharged to the outside from the third communication passage 14*b* via the retarded angle flow passage 8*b*, which changes the relative rotational phase to the advanced angle direction.

Figure 5:
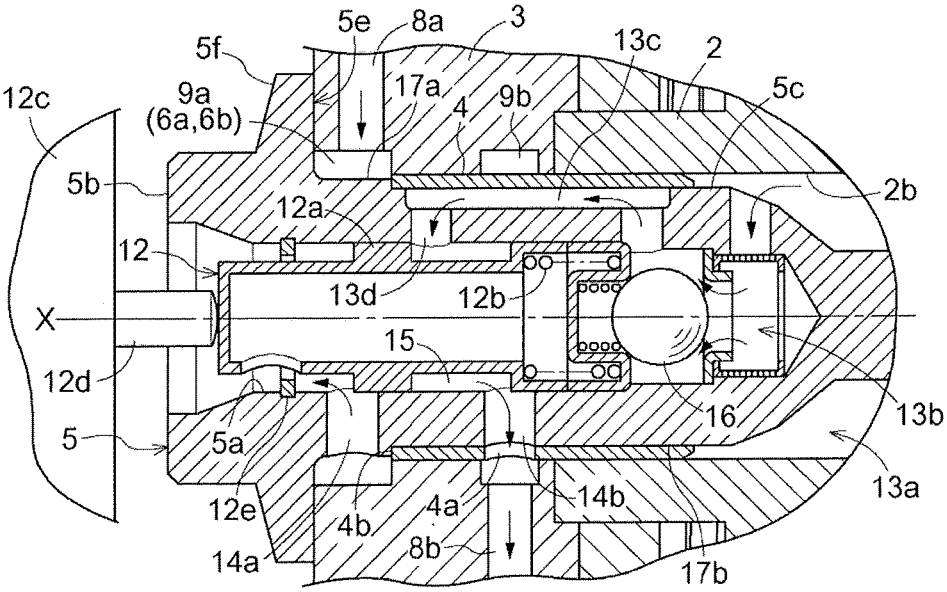
FIG. 5 is a cross-sectional view illustrating a position of the control valve element in a retarded angle control state.

In the retarded angle control state as illustrated in FIG. 5, the spool 12*a* moves to a position at which the first communication passage 13*d* and the third communication passage 14*b* are in communication with each other via the valve element peripheral groove 15 and the second communication passage 14*a* is in communication with the inner void 5*a*. In the retarded angle control state, the oil is supplied to the retarded angle chamber 7*b* via the retarded angle flow passage 8*b* and the oil at the advanced angle chamber 7*a* is discharged to the outside via the advanced angle flow passage 8*a*, which changes the relative rotational phase to the retarded angle direction.

In the present embodiment, the sleeve 4 that forms the introduction passage 13*c* with the cylinder shaft portion 5*c* is fitted outward and fixed to the cylinder shaft portion 5*c*. Thus, the sleeve 4 is configured to be fixed without being sandwiched between the inner rotor 3 and the camshaft 2 in the direction of the rotation axis X.

Therefore, a compression force caused by the tightening of the OCV bolt 5 is inhibited from being applied to the sleeve 4. The sleeve 4 is thus inhibited from being deformed even in a case where the sleeve 4 is made of a material including a low strength such as aluminum alloy and resin. As a result, a sealing performance of each flow passage is maintained. The valve opening and closing timing control apparatus A including a high responsiveness of a phase control is reasonably obtainable while a freedom of choosing a material of the sleeve 4 is enhanced.

Second Embodiment

Figure 10:
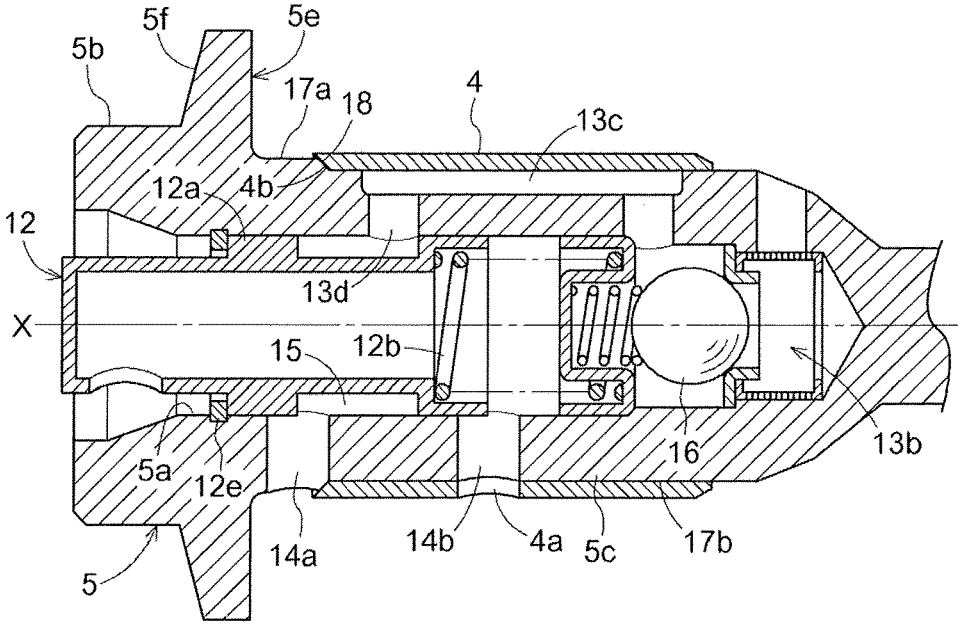
FIG. 10 is a cross-sectional view of the bolt where the cylinder shaft portion according to a second embodiment is press-fitted to the cylindrical member.

FIG. 10 illustrates a modified example of the first embodiment. In the present embodiment, contact surfaces at which the sleeve 4 and the large diameter portion 17*a* face each other in the direction of the rotation axis X, i.e., a surface forming the stepped portion 18 between the large diameter portion 17*a* and the small diameter portion 17*b* and the bolt head-side end surface 4*b* of the sleeve 4, are formed by tapered surfaces (conical surfaces) each of which is separating from the rotation axis X while approaching the bolt head 5*b*. A contact area between the sleeve 4 and the stepped portion 18 is enlarged. At this time, only one of the surface forming the stepped portion 18 and the bolt head-side end surface 4*b* of the sleeve 4 may be formed by the conical surface which is separating from the rotation axis X while approaching the bolt head 5*b*.

The sleeve 4 is press-fitted to the small diameter portion 17*b* over a position at which the bolt head-side end surface 4*b* covers an opening of the second communication passage 14*a* in an eaves manner to thereby increase a press-contact area between the sleeve 4 and the cylinder shaft portion 5*c*. Accordingly, while an increase of an oil passing resistance at the second communication passage 14*a* is restrained, the sealing ability between the sleeve 4 and the cylinder shaft portion 5*c* may improve. The other construction is the same as the first embodiment.

Third Embodiment

Figure 11:
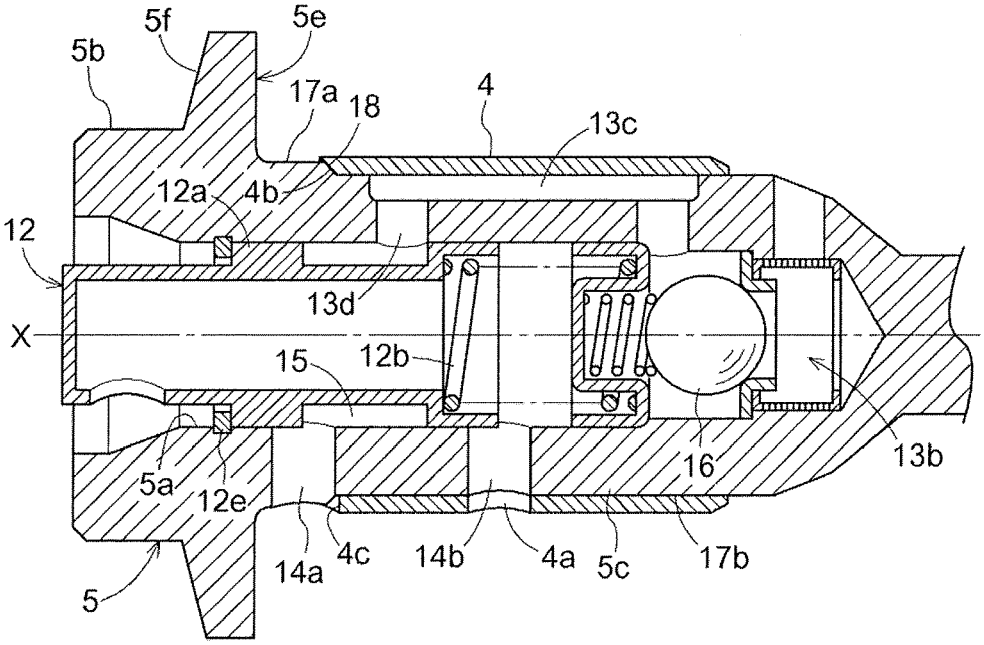
FIG. 11 is a cross-sectional view of the bolt where the cylinder shaft portion according to a third embodiment is press-fitted to the cylindrical member.
Figure 12:
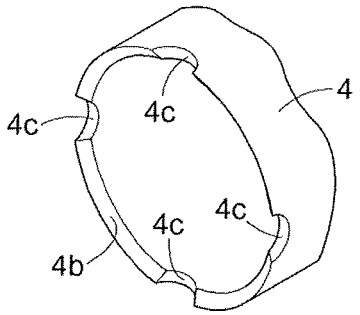
FIG. 12 is a perspective view illustrating the cylindrical member (sleeve) according to the third embodiment.

FIGS. 11 and 12 each illustrate a modified example of a third embodiment. In the present embodiment, the sleeve 4 is press-fitted to the small diameter portion 17*b* in a state where the sleeve 4 enters into an opening range of the second communication passage 14*a*. A cutting 4*c* conforming to an opening configuration of the second communication passage 14*a* is provided at an end portion of the sleeve 4 facing the bolt head 5*b*.

Accordingly, while the increase of the oil passing resistance at the second communication passage 14*a* is restrained, the press-contact area between the sleeve 4 and the cylinder shaft portion 5*c* may increase, so that the sealing ability at the boundary face between the sleeve 4 and the cylinder shaft portion 5*c* may improve. The other construction is the same as the first embodiment.

Fourth Embodiment

Figure 13:
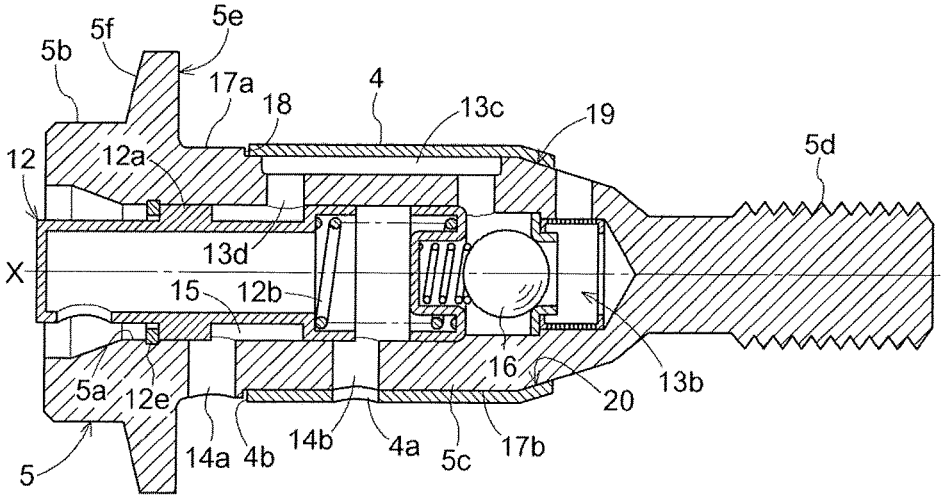
FIG. 13 is a cross-sectional view of the bolt where the cylinder shaft portion according to a fourth embodiment is press-fitted to the cylindrical member.
Figure 14:
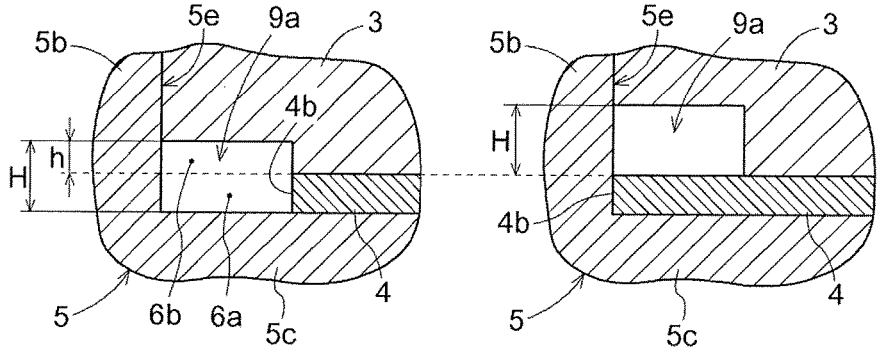
FIG. 14 is a cross-sectional view explaining the present invention.

FIG. 13 illustrates the valve opening and closing timing control apparatus A according to a different embodiment. In the present embodiment, the OCV bolt 5 includes a first contact surface 19 formed at a stepped portion which is provided between the cylinder shaft portion 5*c* and the externally threaded portion 5*d*. The sleeve 4 includes a second contact surface 20 at an inner peripheral side. The second contact surface 20 makes contact with the first contact surface 19 before the sleeve 4 makes contact with the stepped portion 18 at a time of an insertion of the cylinder shaft portion 5*c*.

In the present embodiment, the first contact surface 19 and the second contact surface 20 are formed by tapered surfaces (conical surfaces) of which diameters decrease towards the externally threaded portion 5*d*. That is, a distance from the rotation axis X to an end portion of the sleeve 4 at a side where the externally threaded portion 5*d* is provided decreases towards the externally threaded portion 5*d*. The second contact surface 20 is formed by plastic forming of the sleeve 4. The first contact surface 19 and the second contact surface 20 may be formed by curving surfaces (arc surfaces) of which diameters decrease towards the externally threaded portion 5*d*. The other construction is the same as the first embodiment.

Fifth Embodiment

In the first to fourth embodiments, reference numerals 8*a*, 9*a* 14*a* may be the retarded angle flow passage, the retarded angle annular flow passage and the third communication passage respectively and reference numerals 8*b*, 9*b* and 14*b* may be the advanced angle flow passage, the advanced angle annular flow passage and the second communication passage respectively which are not illustrated. In such embodiment, the retarded angle annular flow passage 9*a* is formed with the predetermined depth H by the first annular void 6*a* and the second annular void 6*b*. A combination of the third communication passage 14*a* and the retarded angle flow passage 8*a* are in communication with the first annular void 6*a*.

Accordingly, in the valve opening and closing timing control apparatus A of the present embodiment, the power supply to the electromagnetic solenoid 12*c* is stopped so that the spool 12*a* is switched to the retarded angle control state. The power supply volume to the electromagnetic solenoid 12*c* is controlled so that the spool 12*a* is switched to either the neutral state or the advanced angle control state.

Other Embodiments

1. In the valve opening and closing timing control apparatus of the invention, an elongated groove constituting the introduction passage may be provided at the cylindrical member (sleeve).
2. In the valve opening and closing timing control apparatus of the invention, the cylindrical member (sleeve) may be adhered and fixed to the outer peripheral surface of the cylinder shaft portion.

INDUSTRIAL AVAILABILITY

The present invention is applicable to a valve opening and closing timing control apparatus mounted at an internal combustion engine of various applications other than an internal combustion engine of an automobile.

EXPLANATION OF REFERENCE NUMERALS

1: housing (driving-side rotational body)
2: camshaft
3: inner rotor (driven-side rotational body)
4: sleeve (cylindrical member)
4*b*: bolt head-side end surface (contact surface)
4*c*: cutting
5: bolt
5*b*: bolt head
5*c*: cylinder shaft portion
5*d*: externally threaded portion
6*a*: first annular void
7*a*: advanced angle chamber
7*b*: retarded angle chamber:
8*a*: advanced angle flow passage
8*b*: retarded angle flow passage
12*a*: control valve element
13*c*: introduction passage
13*d*: first communication passage
14*a*: second communication passage
14*b*: third communication passage
17*a*: large diameter portion
17*b*: small diameter portion
18: stepped portion (contact surface)
19: first contact surface
20: second contact surface
E: engine (internal combustion engine)
E2: crankshaft (drive shaft)
X: rotation axis

The invention claimed is:

1. A valve opening and closing timing control apparatus comprising a driving-side rotational body synchronously rotating with a drive shaft of an internal combustion engine;

a driven-side rotational body supported at an inner side of the driving-side rotational body to be rotatable at a rotation axis serving as a common rotation axis between the driven-side rotational body and the driving-side rotational body, the driven-side rotational body integrally rotating with a camshaft for opening and closing a valve of the internal combustion engine;

a cylindrical member provided at an inner portion of the driven-side rotational body;

a bolt including a cylinder shaft portion inserted to be positioned at an inner side of the cylindrical member, a bolt head continuously provided to the cylinder shaft portion and an externally threaded portion being different from the bolt head and continuously provided to the cylinder shaft portion, the bolt connecting the driven-side rotational body and the camshaft;

an advanced angle chamber and a retarded angle chamber defined and provided between the driving-side rotational body and the driven-side rotational body;

an advanced angle flow passage and a retarded angle flow passage provided at the driven-side rotational body, the advanced angle flow passage being in communication with the advanced angle chamber, the retarded angle flow passage being in communication with the retarded angle chamber;

an introduction passage provided at least at one of the cylinder shaft portion and the cylindrical member between the cylinder shaft portion and the cylindrical member, the introduction passage bringing a working fluid supplied from an outside to flow along a direction of the rotation axis;

a first connection passage provided at the cylinder shaft portion to bring the working fluid at the introduction passage to flow to an inner side of the cylinder shaft portion, a second communication passage and a third communication passage arranged at different positions from each other at the cylinder shaft portion along the direction of the rotation axis; and a control valve element provided at the inner side of the cylinder shaft portion to move in a reciprocating manner along the rotation axis, the control valve element supplying the working fluid from the first communication passage to the second communication passage or the third communication passage, either a combination of the second communication passage and the advanced angle flow passage or a combination of the third communication passage and the retarded angle flow passage being in communication with a void provided between the bolt head and the cylindrical member and between the cylinder shaft portion and the driven-side rotational body.

2. The valve opening and closing timing control apparatus according to claim 1, wherein an outer peripheral surface of the cylinder shaft portion is press-fitted to an inner peripheral surface of the cylindrical member.

3. The valve opening and closing timing control apparatus according to claim 1, wherein the cylinder shaft portion includes an outer diameter greater than an outer diameter of the externally threaded portion, the bolt includes a first contact surface provided at a stepped portion which is provided between the cylinder shaft portion and the externally threaded portion, the cylindrical member includes a second contact surface which makes contact with the first contact surface at a time of an insertion of the cylinder shaft portion to the cylindrical member.

4. The valve opening and closing timing control apparatus according to claim 1, wherein the cylinder shaft portion includes a large diameter portion adjacent to the bolt head and a small diameter portion including a smaller diameter than the large diameter portion and inserted to be positioned within the cylindrical member, the cylindrical member includes a greater outer diameter than the large diameter portion.

5. The valve opening and closing timing control apparatus according to claim 4, wherein at least one of a contact surface of the cylindrical member and a contact surface of the larger diameter portion, the contact surfaces at which the cylindrical member and the larger diameter portion face each other in the direction of the rotation axis, is separating from the rotation axis while approaching the bolt head.

6. The valve opening and closing timing control apparatus according to claim 1, wherein a cutting is provided at an end portion of the cylindrical member facing the bolt head, the cutting conforming to an opening configuration of the second communication passage or the third communication passage.

7. The valve opening and closing timing control apparatus according to claim 1, wherein a distance from the rotation axis to an end portion of the cylindrical member decreases towards the externally threaded portion.

* * * * *